United States Patent [19]

Haftke et al.

[11] Patent Number: 4,635,567

[45] Date of Patent: Jan. 13, 1987

[54] MONITORING OF BURNER OPERATION

[75] Inventors: Jozef J. Haftke; Norman G. Worley, both of Sidcup; Colin R. Coleman, Kingston-upon-Thames; Anne-Marie Warris, London, all of Great Britain

[73] Assignee: Babcock Power Limited, London, England

[21] Appl. No.: 779,290

[22] PCT Filed: Jan. 25, 1985

[86] PCT No.: PCT/GB85/00037

§ 371 Date: Sep. 24, 1985

§ 102(e) Date: Sep. 24, 1985

[87] PCT Pub. No.: WO85/03340

PCT Pub. Date: Aug. 1, 1985

[30] Foreign Application Priority Data

Jan. 25, 1984 [GB] United Kingdom ..... 8401866

[51] Int. Cl.[4] ..... F23N 5/18

[52] U.S. Cl. ..... 110/188; 110/104 B; 110/265; 236/15 BA; 236/15 BD

[58] Field of Search ..... 110/185, 186, 187, 188, 110/189, 261, 265, 104 R, 104 B; 236/15 R, 15 BA, 15 BD, 15 C

[56] References Cited

U.S. PATENT DOCUMENTS

| | | | |
|---|---|---|---|
| 3,395,657 | 8/1968 | Schuss | 110/189 |
| 4,033,505 | 7/1977 | Lutes et al. | 236/15 BD |
| 4,368,678 | 1/1983 | Ulvelihg | 236/15 BA X |
| 4,389,949 | 6/1983 | Heep | 110/186 X |
| 4,424,754 | 1/1984 | Coleman et al. | 110/185 X |
| 4,459,098 | 7/1984 | Turek et al. | 110/188 X |

*Primary Examiner*—Albert J. Makay
*Assistant Examiner*—Steven E. Warner
*Attorney, Agent, or Firm*—Solon B. Kemon

[57] ABSTRACT

Three burners are supplied with pulverized fuel entrained in air from a splitter and are brought to combustion under optimum conditions by adjustment of the secondary air flow to each. The rates of flow of primary and secondary air are determined and signals from these, and a representation of the total fuel supply are supplied to a computer by which the amount of fuel flowing to each burner is deduced from the ratio of the air supplied to the burners.

6 Claims, 3 Drawing Figures

MONITORING OF BURNER OPERATION

In a known form of furnace, several burners are provided with pulverized fuel from a single source, such as a mill, being conveyed from the source in primary air through a single duct to a splitter. Further ducts lead from the splitter, one to each of the burners. The splitter is intended to divide the fuel that flows through it into two or more constant (usually equal) proportions. The division may turn out to be not quite what was intended and might, in any case, vary during operation of the furnace and for the efficient control of the combustion and the maximum efficiency of the plant, particularly with low $NO_x$ combustion systems, it is desirable to know what the fuel flow to each of the burners is.

By means of the present proposal, it is possible to determine the pulverized fuel flow to each burner by reference to the total fuel to a splitter from which the burners depend for, say, a plant that is being commissioned.

According to the present invention, there is provided in the operation of a burner connected in parallel with one or more other burners to a splitter to which pulverized fuel is supplied in a stream of primary air, supplying secondary air to each of the burners so that combustion of the fuel supplied by the burner occurs in optimum conditions, deriving a measure of the total air supply to each of the burners, measuring the total supply of fuel to the splitter, and deriving from that and the ratio of the air supplies the amounts of fuel that are supplied to each of the burners.

In apparatus by which that method may be carried out, there is a plurality of burners supplied in parallel by a single splitter with pulverized fuel entrained in primary air, means by which the flow of fuel to the splitter may be measured, means by which the flow of primary air to the splitter may be measured, means for determining when the flame at each burner is burning under optimum conditions, means for providing a variable supply of secondary air to each burner so that optimum conditions may be established, means for measuring the secondary air supply at optimum conditions and means for deriving from a ratio of the air supplies to each burner and the total fuel supply the amounts of fuel that are supplied to each burner.

Figure 1:
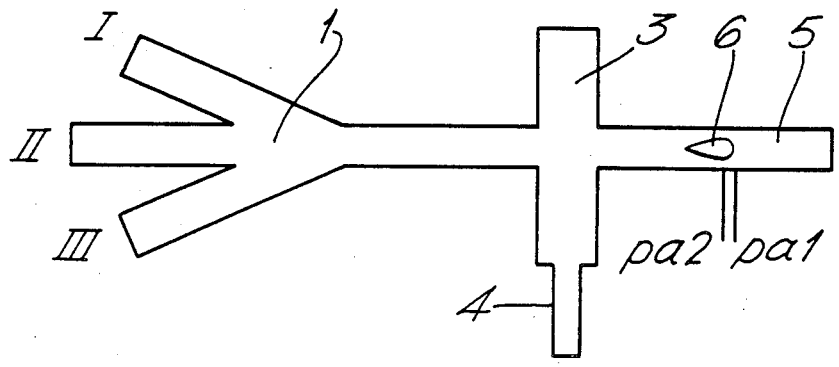
Figure 3:
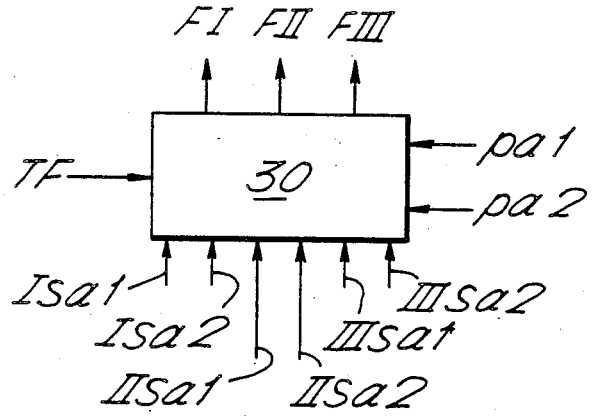
Figure 2:
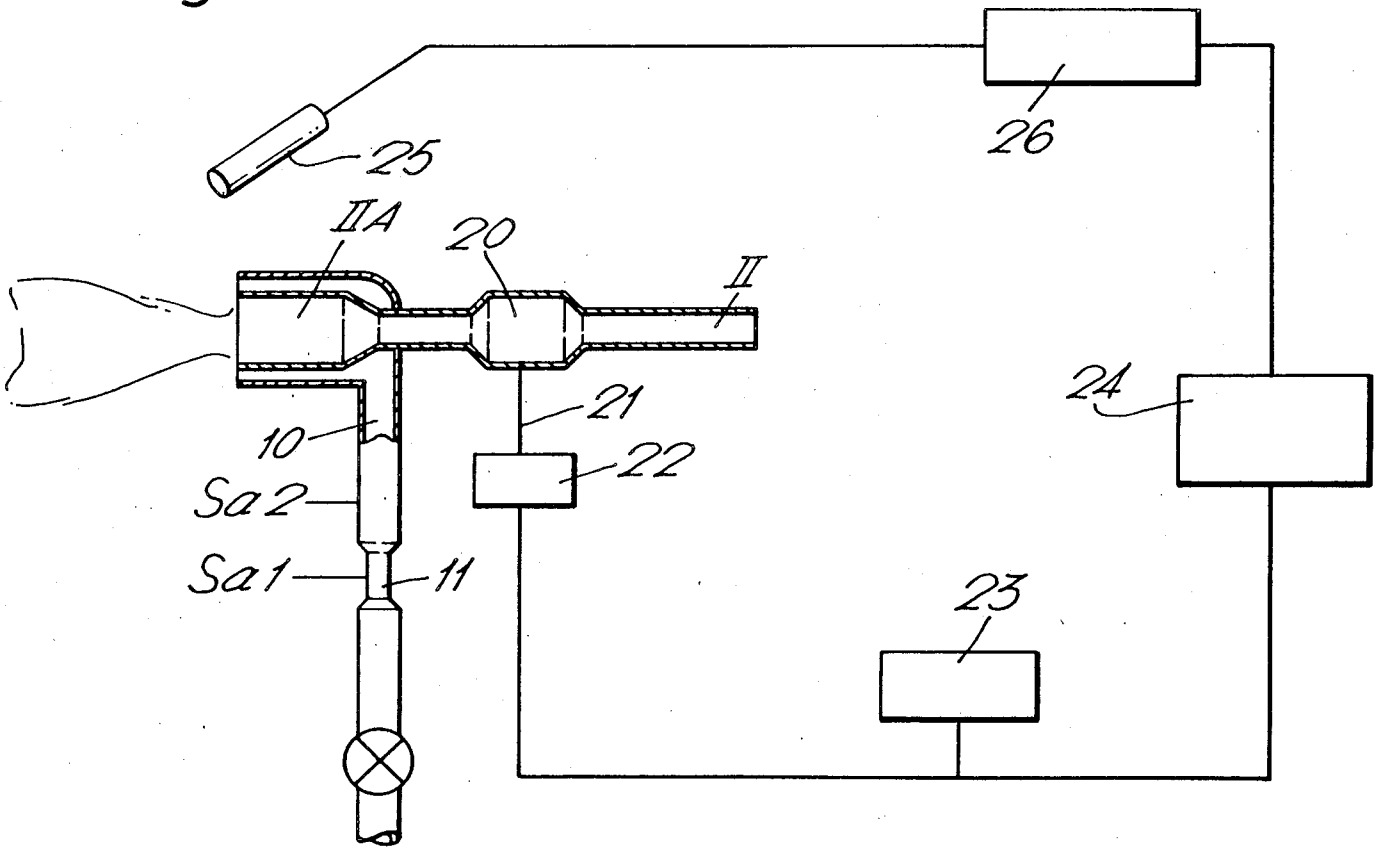

By way of example, an embodiment of the invention will now be described with reference to the accompanying schematic drawing in which:

FIG. 1 indicates a three-way splitter;

FIG. 2 indicates apparatus associated with one of the three burners that are supplied by the splitter; and FIG. 3 indicates apparatus from which information about the flow of fuel to a burner may be obtained.

In FIG. 1, the numeral 1 indicates a splitter of known kind to which are connected, by pipes I.II and III, burners of which one, IIA is denoted in FIG. 2. The splitter is intended to divide the fuel supplied to it in three equal parts. The fuel is pulverized coal; coal is supplied at a known rate TF (measured by known techniques) to the mill 3 through a supply duct 4 and the coal that is pulverized in the mill 3 is entrained in primary air led to the mill through duct 5. The duct 5 contains an aerofoil insert; using a known technique, pressures pa1 and pa2 at the aerofoil insert are taken to enable a measure to be derived of the amount of primary air flowing to the mill 3 and thence through the splitters. In has been found that while the division of fuel at the splitter may vary, the air is divided into its intended portions (in this case, thirds) with adequate consistency.

Each burner is provided with its own adjustable supply of secondary air, flowing to the burner through a duct 10. The duct 10 includes a venturi section 11; again it is known how to deduce air flow from the pressures taken at, and downstream of, the venturi.

In operation of the burners, the supply of secondary air to each is varied until they are operating under optimum conditions.

To tell whether or not the burner is operating under optimum conditions, a known technique is used. This includes introducing intermittent and transient variations into the flow of fuel to the burner and use is made of a vortex amplifier 20 such as is described in our European Patent Publication No. 0070123. This consists essentially of a cylindrical enlargement of the pipe through which fuel flows to the burner and means, indicated at 21, by which air may be introduced in pulses tangentially into the enlargement. The discharge of air will be effective to hold up the flow of fuel. When the pulse is completed, the fuel that has been held up will be released so that for each pulse, the flame becomes leaner and then richer than it was. The temperature of the flame is a maximum when it burns under optimum conditions, and is less if the flame is leaner or richer. As a consequence, if the flame was originally lean, it will become transiently even more lean and then, transiently, richer but the result will be that as a result of that pulse, the flame will show a temperature maximum only once. If the flame was originally rich, the reverse sequence will follow but, even so, the flame temperature will show a maximum only once. If, however, the flame was burning under optimum conditions, the flame temperature will show two variations in the same sense as a consequence of the pulse; the passage from optimum condition to leanness will result in a fall of temperature and the subsequent passage, through optimum conditions, to richness will show a change of temperature in the same sense.

To monitor the temperature of the flame, a photodiode 25 is trained to observe the flame and a signal responsive of the temperature of the flame is produced in the amplifier 26. The supply of pulsing air to the vortex amplifier passes through the controller 22 that is governed by the pulse generator 23. The pulse generator 23 is also connected to the comparator 24 by which the effects on the flame of the pulse to the vortex amplifier are correlated to the pulse that occasions them. The comparator 24 is appropriate to tell whether the effects on the flame are those to be expected of a flame operating at optimum conditions or not and produce an indication when optimum conditions have been obtained.

When the flames are all burning at optimum conditions, the pressures pa1 and pa2 that characterized the primary air flow, the pressures Isa1, Isa2, IIsa1, IIsa2, IIIsa1 and IIIsa2 that characterized the secondary air flows and a signal that characterizes the total fuel supply, TF, are fed to an appropriately programmed computer, 30, that produces readings FI, FII and FIII of the fuel flow to each burner. The computer depends upon the observation that when the burners are operating at optimum conditions, the ratio of the rates at which air flows to each burner will be the same as the ratios at which fuel flows to the burners.

We claim:

1. In the operation of a burner connected in parallel with one or more other burners to a splitter to which pulverized fuel is supplied in a stream of primary air, supplying secondary air to each of the burners so that combustion of the fuel supplied by the burner occurs in optimum conditions, deriving a measure of the total air supply to each of the burners, measuring the total supply of fuel to the splitter, and deriving from that and the ratio of the air supplies the amounts of fuel that are supplied to each of the burners.

2. In an operation as claimed in claim 1, the supply of fuel to any burner from the splitter is intermittently and transiently varied so that the flame first becomes leaner and then richer and detection is made of any consequential change of the temperature of the flame twice in the same sense.

3. Burner apparatus including a plurality of burners and means by which they may be supplied in parallel through a single splitter with pulverized fuel entrained in primary air, means by which the flow of fuel to the splitter may be measured, means by which the flow of primary air to the splitter may be measured, means for determining when the flame at each burner is burning under optimum conditions, means for providing a variable supply of secondary air to each burner so that optimum conditions may be established, means for measuring the secondary air supply at optimum conditions, and means for deriving from a ratio of the air supplied to each burner and the total fuel supply the amounts of fuel that are supplied to each burner.

4. Apparatus as claimed in claim 3, in which the means for determining when the flame at any burner is burning under optimum conditions includes means downstream of the splitter for intermittently and transiently varying the flow of fuel to the burner so that the flame first becomes leaner and then richer, and means for responding to the nature of the consequent variation of the temperature of the flow, and means being such as to detect if the temperature changes twice in the same sense of varying the flow of fuel.

5. Apparatus as claimed in claim 3, in which the means for measuring the secondary air supply to any burner includes a venturi included in a duct through which secondary air is supplied to the burner.

6. Apparatus as claimed in claim 3 or 5 in which the means by which the supply of primary air may be measured includes an aerofoil insert disposed in a duct through which primary air is supplied to the entrained fuel.

* * * * *